US005368334A

United States Patent [19]

Christy et al.

[11] Patent Number: 5,368,334

[45] Date of Patent: Nov. 29, 1994

[54] VARIABLE DATA CLEAR MARK IMAGING

[75] Inventors: Orrin D. Christy, North Tonawanda; John E. Pickett, East Amherst; Leo Swanson, Niagara Falls; Mark A. Matheis, North Tonawanda, all of N.Y.; Marc Cousoulis, Fairfield, N.J.

[73] Assignee: Moore Business Forms, Inc., Grand Island, N.Y.

[21] Appl. No.: 74,670

[22] Filed: Jun. 10, 1993

[51] Int. Cl.[5] ..... B42D 15/00

[52] U.S. Cl. ..... 283/67; 283/72; 283/95; 283/114; 283/901; 430/10; 430/97; 428/916

[58] Field of Search ..... 283/72, 95, 901, 114, 283/67, 94, 111; 430/10, 97; 428/916

[56] References Cited

U.S. PATENT DOCUMENTS

| | | | |
|---|---|---|---|
| 1,002,600 | 9/1911 | Morris et al. . | |
| 3,989,279 | 11/1976 | Levy . | |
| 4,051,283 | 9/1977 | Thomas et al. | 283/72 X |
| 4,465,754 | 8/1984 | Kuin et al. | 430/97 X |
| 4,477,593 | 10/1984 | Tomlinson . | |
| 4,940,690 | 7/1990 | Skees . | |
| 4,992,347 | 2/1991 | Hawkins et al. | 430/10 |
| 5,058,925 | 10/1991 | Dotson . | |
| 5,139,572 | 8/1992 | Kawashima . | |
| 5,286,061 | 2/1994 | Behm | 283/95 |

FOREIGN PATENT DOCUMENTS

| | | | |
|---|---|---|---|
| 0090130 | 10/1983 | European Pat. Off. | 283/95 |
| 3211102 | 10/1983 | Germany | 283/95 |
| 1255445 | 12/1971 | United Kingdom | 430/97 |
| 2153107 | 8/1985 | United Kingdom | 430/97 |

*Primary Examiner*—Mark Rosenbaum
*Assistant Examiner*—Frances Han
*Attorney, Agent, or Firm*—Nixon & Vanderhye

[57] ABSTRACT

A security document is produced from a paper substrate having invisible hydrophobic toner blended into the paper. The clear toner is produced by milling and classifying a polyester resin, mixing it with silica flowing agent, and then electrostatically imaging the toner onto the paper substrate, as a spot that can be overprinted, or preferably as indicia that is not visible to the naked eye or color copiers. An infra-red absorbing or UV responsive dye may be added to the toner so that it is visible under infra-red/ultraviolet light respectively, or without that dye it is not visible when eliminated by light of any wavelength. When applied to the paper the toner is snow white, but after infra-red heat fusing it blends into the paper and is substantially invisible. The security indicia is easily made visible by passing a conventional marker nib over it, or other mechanism for applying a water based low concentrate colored ink which is readily absorbed by the surrounding paper, but not by the hydrophobic security indicia.

19 Claims, 2 Drawing Sheets

VARIABLE DATA CLEAR MARK IMAGING

BACKGROUND AND SUMMARY OF THE INVENTION

There are many circumstances in which it is desirable to print invisible indicia or areas on a paper substrate, and then make those areas visible in a simple and easy manner. Such a need exists in the production of educational forms, but is particularly useful in the security document area. Especially with the introduction of modern color copiers, amateur and professional counterfeiters can reproduce all sorts of valuable documents, such as admission tickets, passes, coupons, certificates, bank checks, lottery tickets, money orders, and the like. Many businesses and agencies suffer substantial losses as a result of the production and distribution of such bogus documents, yet most cannot justify the cost of security devices that are conventionally available to protect against this type of fraud.

According to the present invention, a method and product are provided in which essentially invisible indicia or spots are easily applied, utilizing conventional equipment, to a paper substrate. By using a simple conventional highlighting marker, or the like, one can easily test the document for authenticity, or otherwise utilize the document, by making the hidden indicia clearly visible. Since the invention utilizes very simple components, conventional equipment, and simple techniques, it can produce a security document such as a ticket, bank check, stock certificate, coupon, or the like, at almost no increase in cost compared to a non-protected document.

The basic aspect of the present invention is the utilization of a clear toner which can be electrostatically imaged onto a piece of paper, as by using a dual roller fluidized electrostatic bed applicator. The toner, which is simple to construct, is initially applied to the paper, in its virgin form, as a snow white deposit, which has a clear contrast with the surface of the paper (even if itself white). However then when the toner is heated to fuse it, as by a conventional infra-red heat fuser, it melts into the fibers of the paper and turns clear so that it is essentially invisible to the naked eye when illuminated by any wavelength of light (unless a particular dye is added to it to intentionally make it visible when illuminated by infra-red or UV light). The applied toner is hydrophobic, so that when a water base low concentrate ink, such as in a colored felt tip marker, or the like, is applied to the paper substrate at the area of the imaged toner, the toner itself repels the marker, but the surrounding paper readily absorbs it, so that the toner is clearly visible as a "negative" image. This allows one, for example a ski lift operator, to easily and simply check the authenticity of presented documents, such as ski lift tickets. The person checking the ski lift ticket need only use a conventional marker, and know where to mark the presented ticket to render visible the security indicia. The clear security indicia cannot be reproduced successfully even by a modern color copier.

According to one aspect of the present invention, a method of providing and using security indicia on a paper substrate utilizing a substantially clear hydrophobic toner is provided, the method comprises the following steps: (a) Charging and applying the toner in the form of security indicia to the paper substrate. (b) Heat fusing the toner so that it blends into the paper and becomes substantially invisible to the naked eye and color copiers regardless of the wavelength of light directed onto it. And, (c) when it is desired to view the indicia, applying an aqueous based solvent system having a distinctly different color than the paper substrate to the paper substrate over the toner, the paper surrounding the toner indicia absorbing the solvent while the toner indicia does not, making the toner indicia visible.

Step (a) is practiced by imaging the toner onto the paper electrostatically, e.g. using ionographic, laser, and ion deposition imaging techniques, and step (b) is typically practiced by infra-red heat fusing. Step (a) is further practiced by using a polyester resin based toner which has been milled and classified so that the particle size is very uniform, and mixed with a silica flowing agent. The toner may be variably imaged on the paper, and also visible indicia corresponding to the invisible indicia may also be variably imaged onto the paper. Alternatively, it can be overprinted, or overcoated, for example by applying foil over it. If it is desirable to make the indicia visible in certain light wavelengths, a UV responsive dye or an infra-red absorbing dye may be added to the toner. The invention also contemplates a security document made by the method described above.

According to another aspect of the present invention, a security document is provided comprising: A substantially paper substrate; and indicia imaged on the substrate comprising a hydrophobic toner blended into the paper substrate so that it is substantially invisible to the naked eye and color copiers when illuminated with ambient light.

The invention also comprises another type of security document, particularly useful in making lotto tickets or the like which has a different receptivity to overprinted inks and coatings for rub off or image permanence considerations. The security document according to this aspect of the invention comprises: A paper substrate. A spot of hydrophobic toner imaged onto and blended into the paper substrate so that it is substantially invisible to the naked eye and color copiers when illuminated with ambient light. And, an overcovering or overprinting on the spot.

The invention also contemplates a method of treating a substrate comprising the following steps: (a) Producing a clear toner by milling a polyester resin to an average particle size of about 15 microns, and classifying the resin to reduce particles of less than about 5 micron to under about 10% of the total distribution of particles, and blending the milled and classified particles with a silica flowing agent, and intimately mixing them together. (b) Electrostatically imaging the toner onto a paper substrate. And, (c) heat fusing the toner, so that it blends into the paper substrate and becomes substantially invisible to the naked eye and color copiers when illuminated with ambient light. Step (b) is typically practiced by imaging the toner on the surface as human or machine readable indicia, and there is typically the further step of imaging visible toner on the substrate corresponding to the invisible toner imaged thereon by the practice of step (b).

It is the primary object of the present invention to provide a simple and effective technique for producing documents having invisible indicia or areas which are readily rendered visible, particularly for security document applications. This and other objects of the invention will become clear from an inspection of the detailed description of the invention and from the appended claims.

DETAILED DESCRIPTION OF THE DRAWINGS

Figure 1:
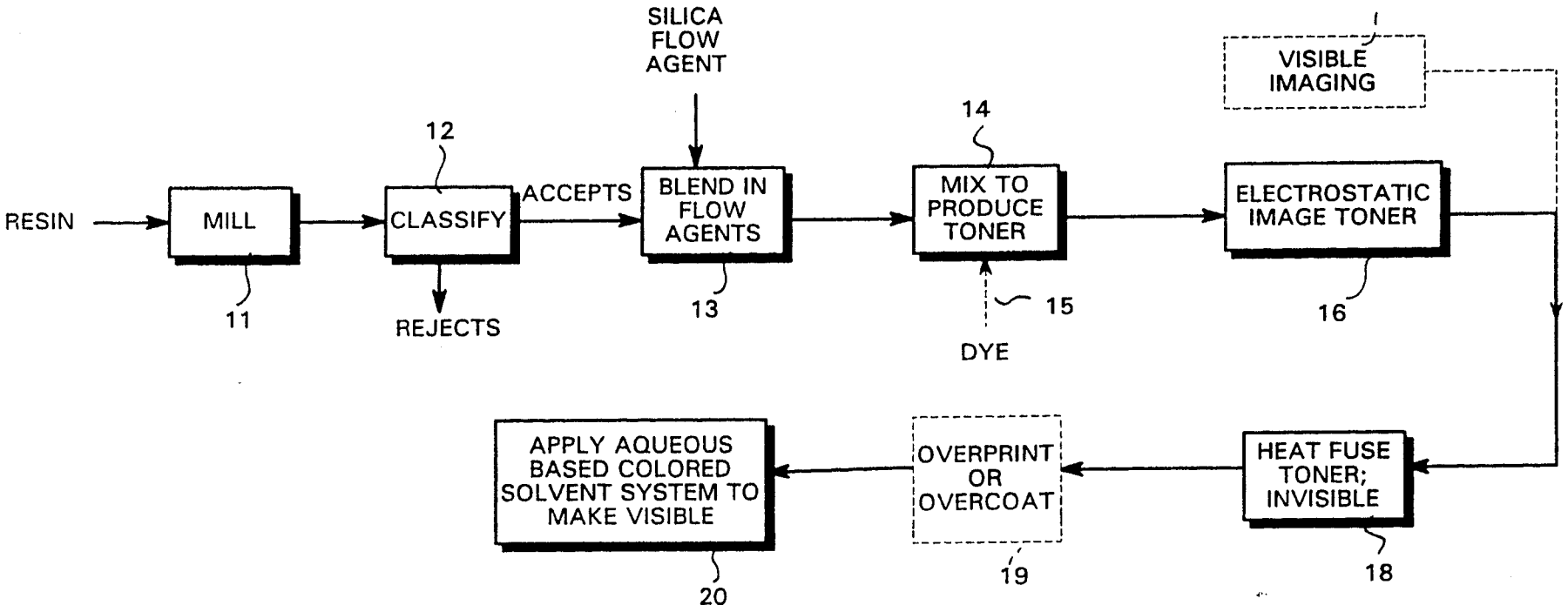
FIG. 1 is a schematic box diagram illustrating exemplary method steps according to the method of the present invention.

Exemplary method for making and using a security document, or like document with invisible indicia or areas that are easily rendered visible, is schematically illustrated in FIG. 1. In the exemplary embodiment illustrated in FIG. 1, a polyester resin is acted upon in stage 11 by milling it (e.g. jet-milling it) to a predetermined average particle size, and after that it is passed to the classifying stage 12 where it is classified to reduce the number of particles below a certain size. Then in stage 13, a flowing agent is added to it, and the flowing agent and resin are intimately mixed at stage 14 to produce a toner. The toner produced thereby will be clear when illuminated by all wavelengths of light after heat fusing, but if it is desirable to render it visible when illuminated by certain wavelengths of light, a conventional infra-red absorbing dye, or a conventional UV responsive dye, may be added as indicated by dotted line 15 in FIG. 1. If an infra-red absorbing dye is added then indicia printed with the toner is visible when illuminated with infra-red light, and if a UV responsive dye is added, indicia printed with the toner fluoresces when illuminated with UV light.

While a wide variety of resins, flow agents, and techniques may be utilized, one particularly advantageous technique for the practice of the stages 11 through 14 of the invention is as follows:

EXAMPLE

A polyester resin (such as ATLAC 382 E by Reichold) was jet milled to an average particle size of about 15 microns, and then classified to reduce particles of less than about 5 microns to under about 10% of the total distribution. The resin powder produced was post-blended with about 0.75% by weight of a treated fumed silica flowing agent, such as Cabot TS-530 or its equivalent, and mixed in a high speed blender such as a Henschell or Omni. The toner so produced was readily available for use in a conventional Midax 300 ionographic print engine and could be imaged onto a paper substrate in a snow white form, and then became clear after heat fusing.

After the toner is produced in stage 14, it is electrostatically imaged onto a substrate as indicated schematically at 16 in FIG. 1. Any of a wide variety of electrostatic imaging techniques and equipment can be utilized. For example ionographic, laser, and ion deposition imaging techniques are useful, as well as their corresponding print engines, such as a Midax 300 ionographic print engine for ionographic techniques. When utilizing an ionographic print engine, the toner is applied with a dual roller fluidized electrostatic bed applicator such as shown in co-pending application Ser. No. 07/639,360 filed Jan. 8, 1991 (atty. dkt. 263-511; 90-42), the disclosure of which is hereby incorporated by reference herein.

Simultaneously with the electrostatic imaging of the clear toner as indicated at stage 16, or prior to that imaging, the paper may also be variably imaged with visible indicia (using a visible toner), as indicated schematically at 17. In any event, after imaging of the clear toner in stage 16, the toner is acted upon by heat to melt it into the paper, rendering it clear. When initially applied to the paper the toner is snow white, but when infra-red heated, the subsequent melting and fusing of the toner causes it to become substantially invisible to the naked eye, and to all presently commercial color copies, including those of Canon (e.g. the Canon laser copier) and Xerox. The heating/fusing step is illustrated by box 18 in FIG. 1.

After fusing of the toner as indicated at 18 in FIG. 1, optionally the toner can be overprint or overcoated. For example if the toner is applied in the form of a spot, it may be overprinted with visible indicia illustrated schematically by stage 19 in FIG. 1. This is particularly useful for lottery and game type applications where the spot would be of a different receptivity to overprinting inks and coatings for rub off or image performance considerations. Alternatively visible indicia can be overprinted on the clear toner indicia.

Ultimately, as indicated at stage 20, if it is desirable to render the invisible indicia visible, stage 20 is practiced. In stage 20 an aqueous based colored solvent system is applied to the toner. The colored solvent is readily absorbed by the surrounding paper, but is repelled by the hydrophobic invisible toner applied in stage 16, thereby rendering it readily visible to the naked eye in a "negative" image form. A wide variety of different types of solvent systems may be utilized, but preferably are water based low concentrate ink aqueous base solvent systems such as are provided in conventional highlighting marks. Examples of numerous commercially available highlighting markers which have been tested as functional and suitable for this purpose are purple and blue "Pilot Spotlighter" markers, fluorescent green "Magic Marker Brand" markers, fluorescent yellow and blue "BIC Brightliner" markers, black and blue "BIC Ultrafine Marking Pen" markers, and red and black "Papermate Flair Pen" markers.

Figure 2:
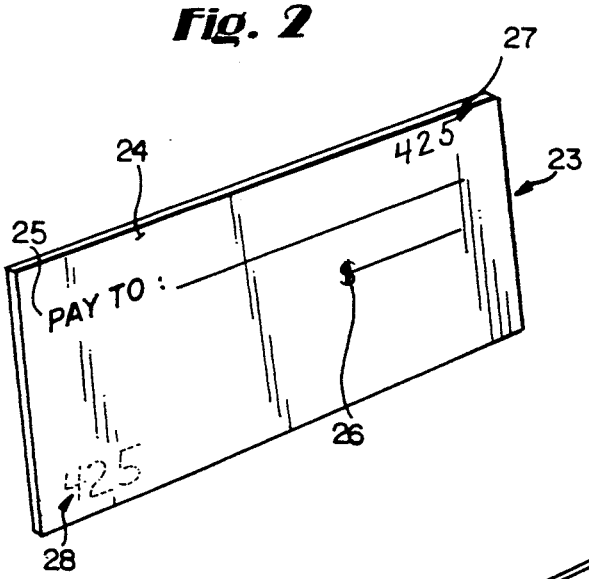
FIGS. 2 through 4 are perspective views of exemplary security documents according to the present invention.

An exemplary security document produced utilizing the basic method illustrated in FIG. 1 is shown schematically at 23 in FIG. 2. The security document includes a paper substrate 24, with various visible indicia thereon such as the "Pay to" indicia 25 and the dollar amount indicia 26, imaged onto the substrate 24 with conventional visible toner. Also in this particular embodiment visible alpha numeric indicia 27 is provided, and the invisible indicia according to the invention—shown schematically in dotted line at 28 in FIG. 2 (it is shown in dotted line because it is impossible to illustrate it otherwise since it is invisible)—corresponding to the indicia 27 is provided. In the use of the security document 23—which typically is a bank check or money order—in order to test its authenticity, all one need do is to rub a magic marker of a distinctly different color than the paper substrate 24 (e.g. non-white, and preferably also non-yellow) over the left bottom area of the paper substrate 24 which will render the indicia 28 visible. If the then visible indicia 28 is not present, then the document is a fraud, or if for some reason it illustrates different indicia than the indicia 27, it is fraudulent.

Figure 3:
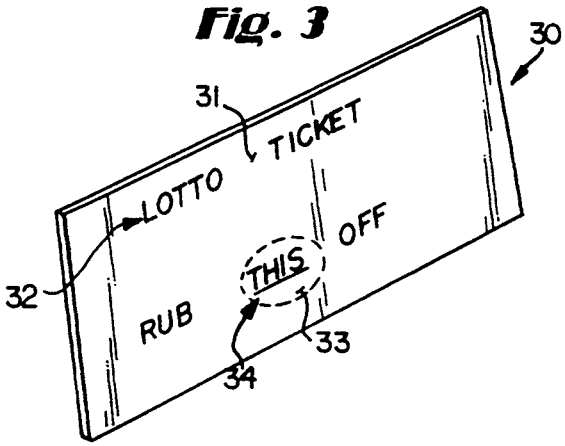

FIG. 3 schematically illustrates another security document 30 according to the invention, this time in the form of a lotto or gaming ticket. Again a paper substrate 31 (e.g. substantially white paper) has conventional visible indicia 32 printed thereon, and in this embodiment a spot or area 33 of invisible toner according to the present invention. Indicia 34 may be overprinted on the spot 33, and the spot 33 can also be applied over preexisting visible indicia on the substrate 31, so that the spot 33 may comprise a rub off spot, or provide for different printing receptivity of the indicia 34, or the like.

Figure 4:
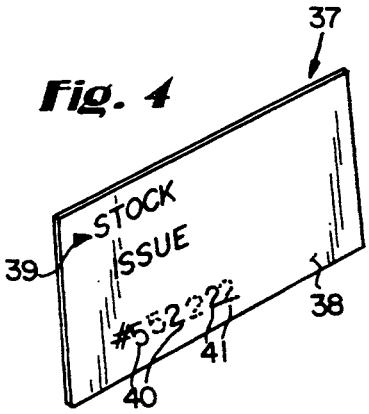

FIG. 4 illustrates another exemplary security document 37 according to the invention, this time in the form, schematically, of a stock certificate. Again a paper substrate 38 has conventional visible indicia 39 printed thereon, as well as overprinting 40 over the invisible alpha numeric indicia 41 that has been applied according to the invention.

Figure 5:
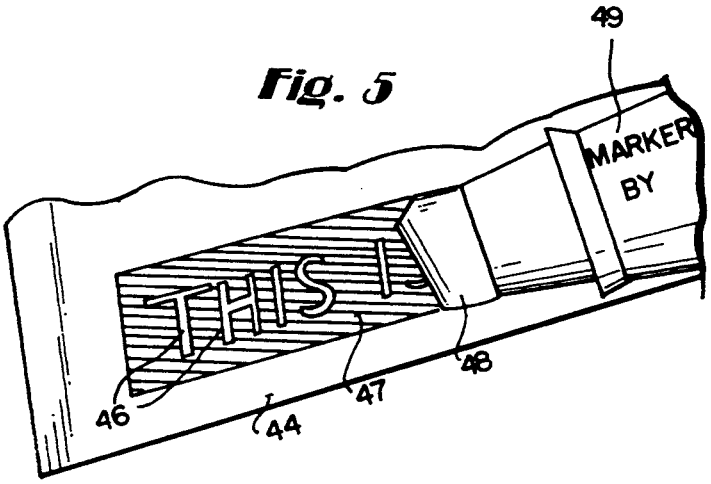
FIG. 5 is a greatly enlarged perspective illustration of a security document according to the present invention showing a conventional highlighting marker being moved over the security indicia printed thereon to render the indicia visible.

FIG. 5 schematically illustrates how the invisible indicia according to the invention is rendered visible, in this particular case schematically illustrated with respect to a ski lift or other admission ticket comprising a white paper substrate 44 that has the invisible indicia 46 imaged thereon (e.g. letter saying "THIS IS A VALID TICKET"). The colored area 47 which renders the previously invisible toner indicia 46 visible is a water based low concentrate ink (e.g. blue as shown in FIG. 5 which has been applied by the nib 48 of a conventional highlighting marker 49, such as "BIC Brightliner" marker. The indicia 46 is clearly visible as a negative image.

It will thus be seen that according to the present invention a simple yet effective method of producing and using security documents, and security documents themselves, have been provided which provide excellent security, yet are readily tested for authenticity. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of providing and using security indicia on a paper substrate using a substantially clear hydrophobic toner, comprising the steps of:

(a) charging and applying the toner in the form of security indicia to the paper substrate;

(b) heat fusing the toner so that it blends into the paper and becomes substantially invisible to the naked eye and color copiers regardless of the wavelength of light directed onto it; and (c) when it is desired to view the indicia, applying an aqueous based solvent system having a distinctly different color than the paper substrate to the paper substrate over the toner, the paper surrounding the toner indicia absorbing the solvent while the toner indicia does not, making the toner indicia visible.

2. A method as recited in claim 1 wherein step (a) is practiced by imaging the toner onto the paper utilizing an imaging technique selected from the group consisting essentially of ionographic, laser, and ion deposition imaging techniques.

3. A method as recited in claim 1 wherein step (a) is practiced by electrostatic imaging.

4. A method as recited in claim 3 wherein step (b) is practiced by infra-red heat fusing.

5. A method as recited in claim 1 wherein step (a) is practiced by charging and applying a polyester resin based toner with a silica flow agent that forms a snow white image on the paper.

6. A method as recited in claim 1 wherein step (c) is practiced by moving an applicator of a marker having a water based low concentrate non-white ink over the toner indicia.

7. A method as recited in claim 1 wherein step (a) is practiced by variably imaging indicia on the paper corresponding to visible imaged indicia on the paper.

8. A method as recited in claim 1 wherein step (a) is practiced by variably imaging indicia on the paper, and comprising the further step of variably imaging visible indicia over the invisible indicia.

9. A security document comprising:

a paper substrate; and indicia imaged on said substrate comprising a hydrophobic toner blended into the paper substrate so that it is substantially invisible to the naked eye and color copiers when illuminated with ambient light.

10. A security document as recited in claim 9 wherein said toner includes an infra-red absorbing dye so that said indicia is visible when illuminated with infra-red light.

11. A security document as recited in claim 9 wherein said toner includes a UV responsive dye so that said indicia fluoresces when illuminated with UV light.

12. A security document as recited in claim 9 further comprising visible indicia corresponding to said invisible indicia imaged on said substrate.

13. A security document as recited in claim 9 further comprising visible indicia overprinted on said invisible indicia.

14. A security document as recited in claim 9 wherein said toner is a polyester resin having a silica flowing agent.

15. A security document as recited in claim 9 wherein said substrate is substantially white paper, and further comprising a distinctly non-white colored aqueous based solvent system disposed over said indicia and said substrate immediately adjacent thereto, the nonwhite colored solvent system being absorbed by the substrate but not by said toner indicia, so as to render said toner indicia visible.

16. A security document comprising:

a paper substrate;

a spot of hydrophobic toner imaged onto and blended into the paper substrate so that it is substantially invisible to the naked eye and color copiers when illuminated with ambient light; and an overcovering or overprinting over said spot.

17. A security document as recited in claim 16 wherein said overprinting or overcovering is selected from the group consisting essentially of overprinted inks and foil coatings.

18. A security document as recited in claim 16 wherein said hydrophobic toner comprises a polyester resin having a silica flowing agent.

19. A paper substrate security document produced by a method comprising the steps of:

(a) charging and applying hydrophobic toner in the form of security indicia to the paper substrate;

(b) heat fusing the toner so that it blends into the paper and is substantially invisible to the naked eye and color copiers regardless of the wavelength of light directed onto it; and (c) applying an aqueous based solvent system having a different color than the paper substrate to the paper substrate over the toner, the paper surrounding the toner indicia absorbing the solvent while the toner indicia does not, making the toner indicia visible.

* * * * *

UNITED STATES PATENT AND TRADEMARK OFFICE

CERTIFICATE OF CORRECTION

PATENT NO. : 5,368,334
DATED : November 29, 1994
INVENTOR(S) : Christy et al.

It is certified that error appears in the above-identified patent and that said letters patent is hereby corrected as shown below:

In the Abstract, line 11, change "eliminated" to – illuminated –.

Signed and Sealed this

Twenty-first Day of February, 1995

*Attest:*

Bruce Lehman

BRUCE LEHMAN

*Attesting Officer*

*Commissioner of Patents and Trademarks*